United States Patent [19]

Lynch

[11] Patent Number: 4,627,220

[45] Date of Patent: Dec. 9, 1986

[54] CONVEYING AND GROUPING OF STRINGED TAGS

[75] Inventor: Steve J. Lynch, Milford, Mass.

[73] Assignee: Dennison Manufacturing Company, Framingham, Mass.

[21] Appl. No.: 770,904

[22] Filed: Aug. 30, 1985

Related U.S. Application Data

[63] Continuation-in-part of Ser. No. 685,925, Dec. 24, 1984.

[51] Int. Cl.[4] ..... B65B 27/10

[52] U.S. Cl. ..... 53/414; 53/135; 53/444; 53/590; 198/425; 198/619

[58] Field of Search ..... 198/425, 619, 740, 468.1; 414/28; 53/414, 134, 135, 582, 586, 589, 590, 444, 443, 148

[56] References Cited

U.S. PATENT DOCUMENTS

| | | | |
|---|---|---|---|
| 2,776,742 | 1/1957 | Langenberg | 198/468.1 X |
| 3,760,245 | 9/1973 | Halvorsen | 198/619 X |
| 3,882,791 | 5/1975 | Youngscap | 198/619 X |
| 3,956,982 | 5/1976 | Hill et al. | 53/589 X |
| 4,054,021 | 10/1977 | Fassbind | 53/148 X |
| 4,067,434 | 1/1978 | Mumford | 198/740 X |
| 4,162,600 | 7/1979 | Westall et al. | 53/590 X |
| 4,219,112 | 8/1980 | Loewenthal | 198/740 X |
| 4,253,289 | 3/1981 | Cole et al. | 53/590 |

*Primary Examiner*—James E. Coan

*Attorney, Agent, or Firm*—George E. Kersey; Gary S. Winer

[57] ABSTRACT

A conveyor has a pivotable upper support which slideably houses two rake assemblies. Stringed tags are collected on the conveyor, then gathered into a bundle by the rake tines. The bundle is presented to a tying appratus, then dropped as the rakes part.

5 Claims, 7 Drawing Figures

CONVEYING AND GROUPING OF STRINGED TAGS

BACKGROUND OF THE INVENTION

The invention relates to the conveyance of stringed tags, and more particularly to the grouping and typing thereof, and is a continuation in part application of Ser. No. 685,925 filed 12/24/84 to the same inventor and assignee.

Stringed tags are produced by mechanical equipment, such as the GRAEBER Inc. Whirlwind 185 Knotter. These machines insert a string through an aperture in a tag and tie a knot in the string. The result is a tag which may be fastened to various articles such as luggage, storage items, or for sale items.

After the stringed tags are produced, they are mechanically inserted between two fixed plates disposed in close conformity, such that the knot lies on one side of the plates, and the tag on the other. The operator then manually counts the stringed tags, or responds to a signal from a counter cooperative with the tying apparatus, and places the stringed tags in containers for distribution or sale to the user.

Copending application Ser. No. 685,925 addresses the problem of separating the tags into visually distinct groups, and provdes for the removal thereof by an operator. Additionally, the bunched tags may be conveyed to containers.

It is an object of the invention to provide for the bundling, or tying of the tag group for either manual or automatic removal from the apparatus, for insertion into containers. As a result, the apparatus can produce many bundles of tags which may be separated one from another when convenient for the operator. Moreover, the bundle represents a convenience to the end user, wherein a bundle may be removed for immediate use, from a container containing a number of separately tied bundles.

SUMMARY OF THE INVENTION

A method and apparatus are provided for gathering stringed tags from a production unit, separating the tags into groups of predetermined number, tying the groups into bundles, and depositing the bundles into containers. An upper support is pivotally mounted above a conveyor. Forward and accumulating rake assemblies are moveably disposed on the upper support, each having a plurality of tines extending in the direction of the conveyor.

The upper support assembly is pivoted by an air cylinder, whereby the forward rake assembly tines are lifted clear of the conveyor.

In a preferred embodiment of the invention, a rodless air cylinder cooperates with the upper support, and is connected to the forward rake assembly, operative to move same on the upper support.

The conveyor is driven in a slow mode by the tag production unit, and in an overspeed mode by a clutch engaged high speed motor. An overrunning clutch enables overspeed of the conveyor with respect to the slow mode input.

In operation, a designated number of stringed tags are collected on the conveyor, at which point the conveyor briefly increases speed to separate the designated tags from incoming tags. A forward rake is lowered into the conveyor behind the incoming tags, and moves forwards in connection with the rodless cylinder, to gather the tags in cooperation with an accumulating rake located at the opposite end of the conveyor. The bundle is supported by the forward and accumulating rakes, and is passed to a tying apparatus where the bundle is secured, as by a paper or plastic coated twisted wire. The tied bundle is withdrawn from the tying apparatus by moving the rakes in an opposite direction. When the bundle is positioned over a discharge zone, the accumulating rake is blocked from further movement. In a preferred embodiment, an air cylinder operates a mechanical stop. The forward rake continues to move along the upper support, thus releasing the bundle.

BRIEF DESCRIPTION OF THE DRAWINGS

Other aspects of the invention will become apparent after considering several illustrative embodiments taken in conjunction with the drawings in which.

DETAILED DESCRIPTION OF THE INVENTION

Figure 1:
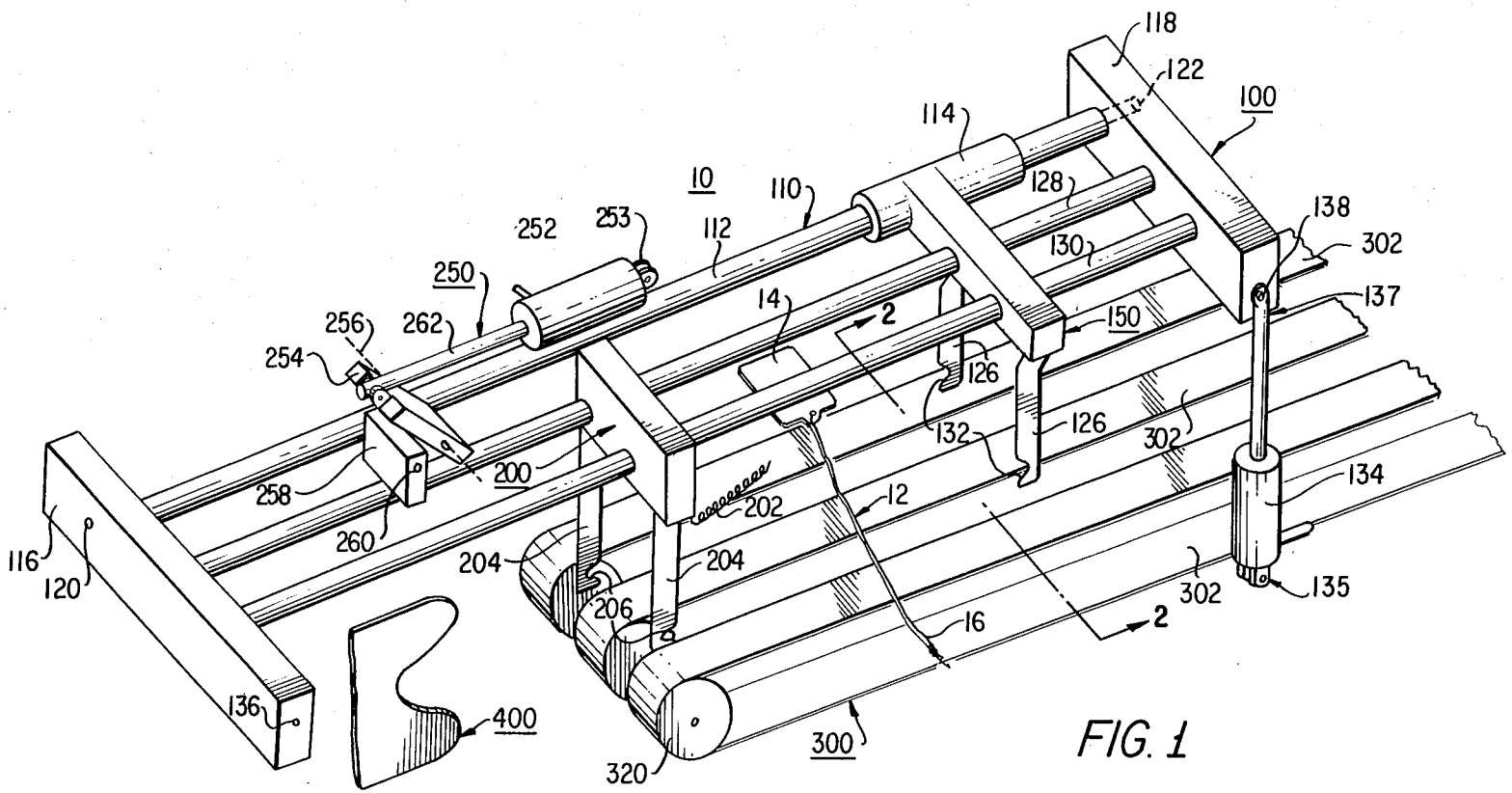
FIG. 1 is a perspective view of an apparatus in accordance with the invention.
Figure 2:
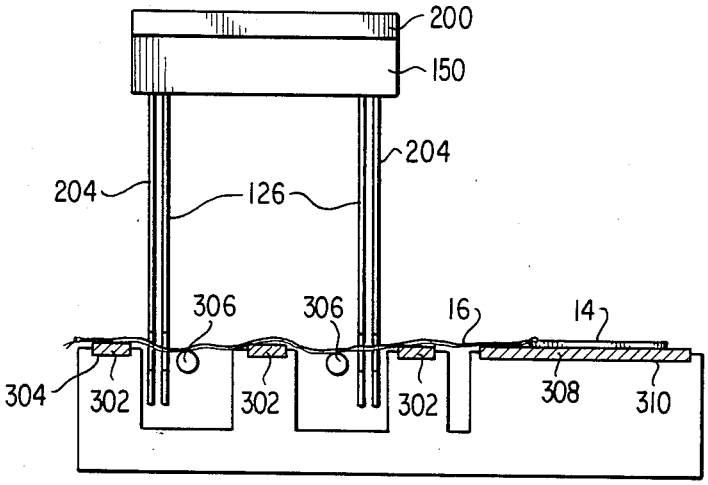
FIG. 2 is a sectional view taken along line 2—2 of FIG. 1.
Figure 3A:
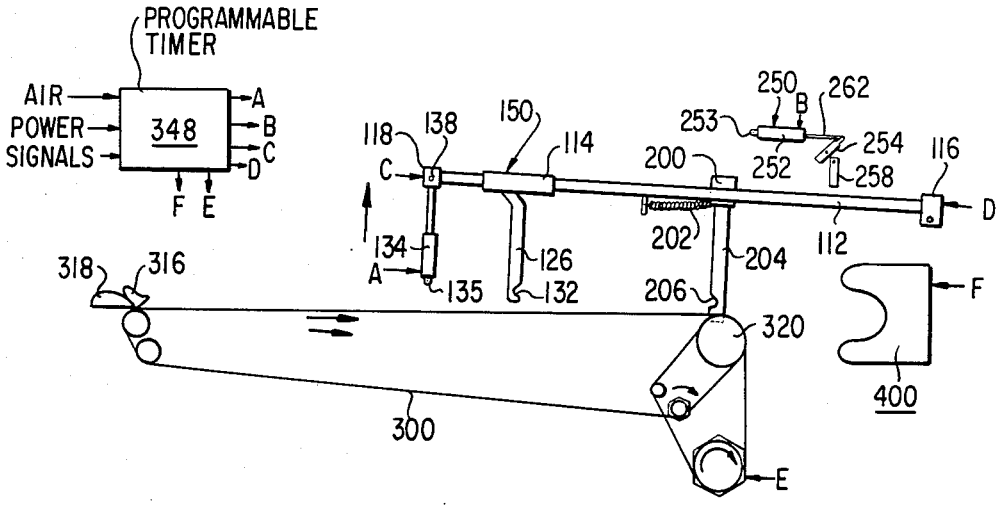
FIGS. 3A–3E are schematic views of the sequence of events in grouping and tying of stringed tags in accordance with the invention.
Figure 3B:
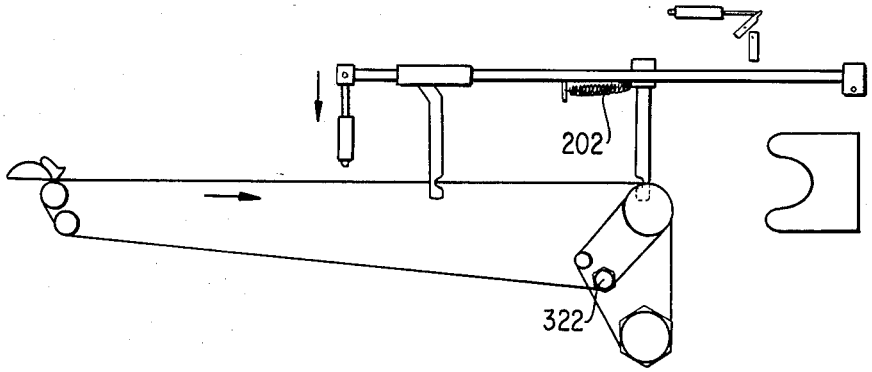
Figure 3C:
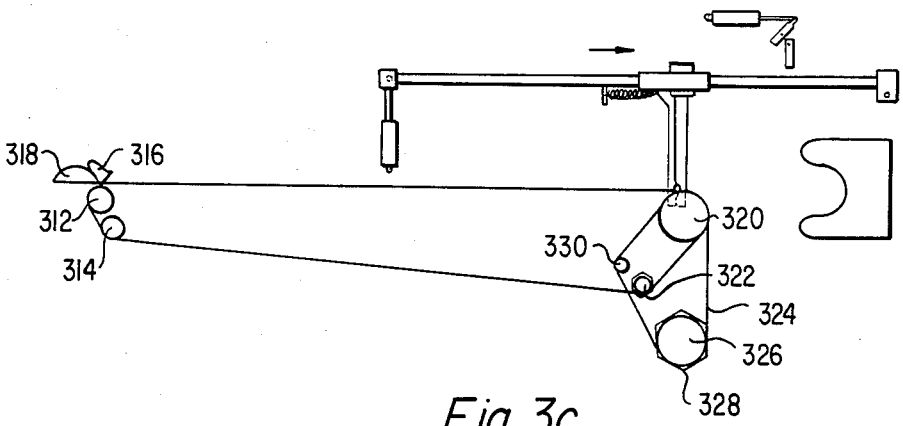
Figure 3D:
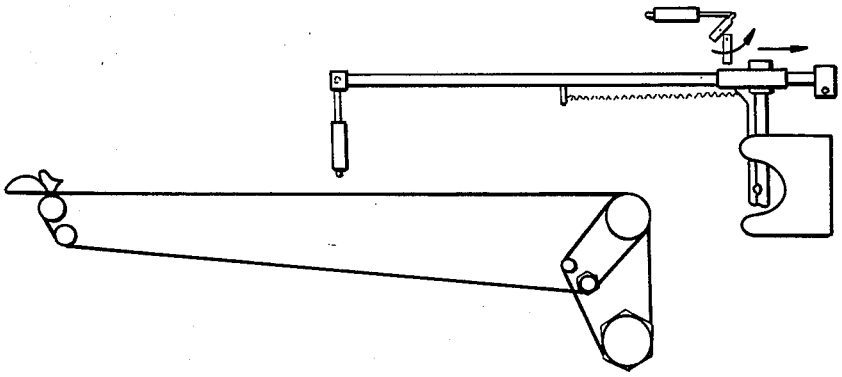
Figure 3E:
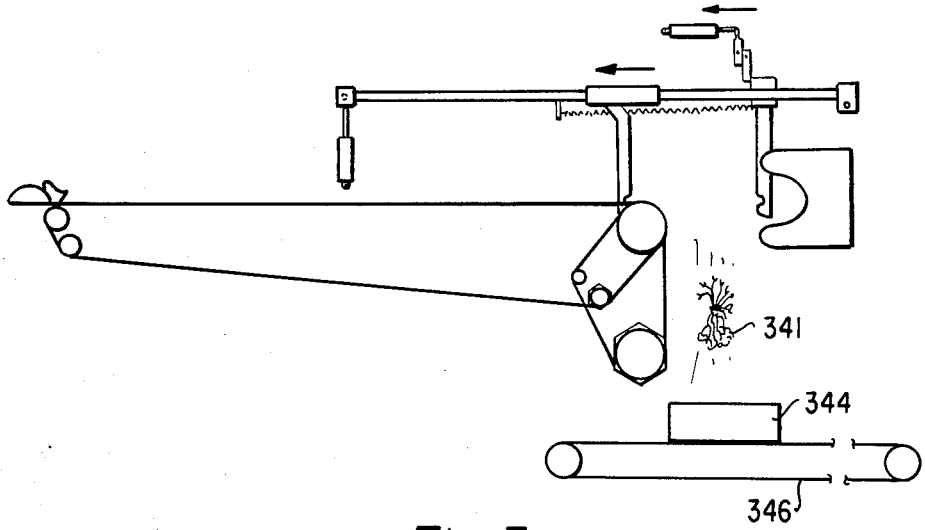

Referring to FIGS. 1–3, the present invention provides a method and apparatus for grouping and tying of stringed tags. An apparatus 10 in accordance with a preferred embodiment includes an upper support 100 having a forward rake 150, an accumulating rake 200, and a rake stop 250. A conveyor 300 is provided for collecting and supporting the stringed tags 12, the latter comprising a card portion 14 and a string 16.

Upper support 100 comprises a rodless cylinder assembly 110 which includes a sleeve 112 and a carriage 114. The sleeve is mounted between two support blocks 116,118. Ports 120,122 are provided in blocks 116,118 communicative with cylinder 112 interior. A magnetic piston is disposed within cylinder 112, and is moved longitudinally within the cylinder as pressurized gas is introduced to either port 120,122. Carriage 114 houses a magnet or ferrous material which is magnetically attracted to the piston.

A forward rake 150 is mounted to carriage 114, and includes tines 126 which extend below and between belts 302 of conveyor 300 when upper support 100 is lowered. Contrarily, when upper support 110 is raised, as discussed further below, tines 126 are raised above the conveyor surface. Support rods 128,130 are provided to slideably support forward rake 150.

An accumulating rake 200 is slideably disposed on rods 128,130, and in connected to a frame by spring 202. Tines 204 extend below and between belts 302 of conveyor 300. Tines 126 are disposed offset with respect to tines 204. Further, notches 132 in tines 126 align with notches 206 in tines 204. Notches 206,132 are disposed to lie partially above belts 302 when upper support 100 is lowered.

An air cylinder 134 is pivotally mounted to a frame at one end 135, and to upper support 100 at the other end 137, operative to raise and lower upper support 100 about pivot 138.

A rake stop assembly 250 is provided to block the path of accumulating rake 200 at a designated point in its travel along rods 128,130. An air cylinder 252 is pivotally connected at 253 to a frame at one end, and to a block 254 at the other end, operative to pivot block 254 about line 256. A second block 258 is pivotally mounted to a frame at 260, and hangs in the path of accumulating rake 200, which extends to a height greater than that of forward rake 150. Block 258 is free to pivot when shaft 262 is extended, but is held motionless against block 254 when shaft 262 is retracted.

Referring to FIGS. 2 and 3, conveyor 300 includes a plurality of belts 302 supported in grooves 304. Belts 302 support strings 16. Rods 306 may be provided to slideably support strings 16. A separate belt 308 supported in groove 310 supports and conveys tags 14. The offset relation of tines 126,204 can be clearly seen in FIG. 2. As shown in FIG. 3, belts 302 travel over pulleys 312,314 at the forward end of the apparatus, below two guide plates 316,318. Guide plates 316,318 promote the progress of strings 16 onto belts 302 as they are discharged from the production unit. An overrunning clutch 320 is disposed at the opposite end of conveyor 300. Belts 302 pass over clutch 320 and pulley 322 to complete a loop. Pulley 322 is coupled to a constantly slow moving shaft, such as an output shaft of the tag production unit, timed to place the strings in close proximity relative to each other upon belt 302 as the tags are produced. A second belt 324 couples overrunning clutch 320 to a motor 326 via a clutch 328 and tensioning pulley 330.

As tags are produced, they are caused to lie across belts 302,208 by guide grooves 316,318 and the production unit. As the tags are slowly conveyed upper support 100 is in a raised position. FIG. 3(*a*). Upon a signal from the production unit, or other sensor, indicating that a designated number of tags have been placed on conveyor 300, clutch 328 engages motor 326, whereby belts 302,308 are rapidly oversped with respect to the speed imparted by pulley 322. As a result, the designated number of tags are accumulated against tines 204. Operation of clutch 328 is timed to return movement of belts 302,308 to pulley 322 after all of the designated tags are forwards of rake 150. At this juncture, upper support 100 is lowered by air cylinder 134, disposing tines 126 behind the last designated tag. FIG. 3(*b*). Pressurized air is introduced to port 122 causing forward rake 150 to travel down rods 128, 130, gathering strips as it moves. At the conveyor end, tines 126, 204 mate to securely hold the gathered strings. FIG. 3(*c*). Forward rake 150 contines to travel, pushing accumulating rake 200 against a force exerted by spring 202. Block 258 pivots freely to allow rake 200 to pass by. FIG. 3(*d*). Rakes 150,200 hold the string bundle at the tying apparatus. A typical apparatus ties a paper or plastic laminated wire, or a string, around the bundle. When tying is complete, pressurized air is introduced into port 120 to drive rake 150 back towards conveyor 300. Pressurized air is introduced to air cylinder 252 in order to retract shaft 262. Thus, block 258 prevents movement of accumulating rake 200 towards the conveyor, as urged by spring 202. FIG. 3(*e*). Accordingly, the tied stringed tag bundle 341 is dropped out of the apparatus into a container 344 on a conveyor 346 below. Air pressure is next released from cylinder 252, allowing block 258 to pivot and thus rake 200 to be drawn back to the end of conveyor 300 by spring 202. Upper support 100 is raised FIG. 3(*a*) as rake 150 is moved to the forward end of conveyor 300, whereby the cycle can be repeated for the next designated number of stringed tags.

The timing of introduction of air into ports 120,122, and to air cylinders 252,134 as well as the actuation of clutch 328 and the tying apparatus, may be appropriately controlled by any of a variety of readily available mechanical or electronic programmable timers 348.

It should be understood that a variety of frame structures may be employed to accommodate the elements of the invention. Pivots 135, 136 are connected to a frame cooperative with conveyor 300. Pivots 138, 253 are connected to a frame cooperative with upper support 100.

The invention thus provides for highly reliable counts of stringed tags, the grouping of these counts into discrete bundles, and the placement of the discrete bundles into containers.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. Apparatus for grouping of stringed tags, comprising:

a frame a conveyor mounted to said frame operative to receive stringed tags;

an upper support pivotally mounted to said frame, disposed above said conveyor;

a forward rake assembly moveably disposed on said upper support;

a plurality of tines connected to said forward rake assembly extending in the direction of said conveyor;

an accumulating rake assembly moveably disposed on said upper support;

a plurality of tines connected to said accumulating rake assembly extending in the direction of said conveyor;

means for pivoting said upper support; and means for moving said forward and accumulating rake assemblies.

2. Apparatus of claim 1, wherein said means for pivoting said upper support comprise an air cylinder connected between said frame and said upper support.

3. Apparatus of claim 1, wherein said means for moving said forward and accumulating rake assemblies comprise a rodless air cylinder cooperative with said upper support, connected to said forward rake assembly.

4. Apparatus of claim 1, wherein said conveyor further comprises:

an overrunning clutch pulley;

at least one belt supported by said overrunning clutch pulley;

means for driving said belt at a first, relatively slow speed;

a clutch connected to said overrunning clutch pulley; and a motor connected to said clutch;

wherein when said clutch is engaged, said belt is oversped with respect to the speed of said driving means.

5. Method of grouping stringed tags, comprising the steps of:

(a) collecting the stringed tags on a conveyor;

(b) conveying the stringed tags at a first speed until a designated number of tags have been collected;

(c) conveying the stringed tags at a second speed to separate the designated number of stringed tags from incoming stringed tags;

(d) lowering a forward rake behind the collected stringed tags;

(e) moving the forward rake to gather the stringed tags until same are held between the forward rake and an accumulating rake;

(f) moving the rakes with the held tags into a tying apparatus to tie the tags;

(g) withdrawing the tied stringed tags from the tying apparatus;

(h) moving the rearward rake away from the forward rake, whereby the tied stringed tags are released.

* * * * *